US007805088B2

(12) United States Patent
Bae

(10) Patent No.: US 7,805,088 B2
(45) Date of Patent: Sep. 28, 2010

(54) IMAGE FORMING APPARATUS

(75) Inventor: Jun Cheol Bae, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 381 days.

(21) Appl. No.: 11/935,005

(22) Filed: Nov. 5, 2007

(65) Prior Publication Data

US 2008/0181627 A1 Jul. 31, 2008

(30) Foreign Application Priority Data

Jan. 31, 2007 (KR) ..... 10-2007-0009967

(51) Int. Cl.
*G03G 15/08* (2006.01)

(52) U.S. Cl. ..... 399/27; 399/258; 399/262; 399/263

(58) Field of Classification Search ..... 399/24, 399/25, 27, 107, 119, 120, 252, 256, 258, 399/262, 263
See application file for complete search history.

(56) References Cited

U.S. PATENT DOCUMENTS 6,148,171 A * 11/2000 Kamijo ..... 399/356
6,882,803 B2 * 4/2005 Ashida et al. ..... 399/27
7,283,755 B2 * 10/2007 Ishiguro et al. ..... 399/27
7,529,492 B2 * 5/2009 Takahashi ..... 399/27

FOREIGN PATENT DOCUMENTS

JP 2004-61971 2/2004
KR 2006-37955 5/2006

* cited by examiner

*Primary Examiner*—Hoan Tran
(74) *Attorney, Agent, or Firm*—Stanzione & Kim, LLP

(57) ABSTRACT

An image forming apparatus equipped with an improved developer detecting device and agitating device to simplify an inner structure of a developing device and/or a waste developer container while reducing the number of components and costs. The image forming apparatus includes a developer storage part to store a developer, a light emitting part and a light receiving part provided to detect an amount of developer stored in the developer storage part, and a rotating unit which rotates to agitate the developer stored in the developer storage part and guides light emitted from the light emitting part to the light receiving part. The rotating unit includes two rotating members. Each of the rotating members has a rotating shaft portion and an extending portion which extends eccentrically from the rotating shaft portion. The extending portions oppose each other to define a developer detecting region therebetween. When the rotating unit rotates, the developer detecting region moves upward and downward. Accordingly, the amount of developer stored in the developing device or the waste developer container can be checked more precisely.

23 Claims, 14 Drawing Sheets

IMAGE FORMING APPARATUS

CROSS-REFERENCE TO RELATED APPLICATIONS

This application claims the benefit of Korean Patent Application No. 2007-0009967, filed on Jan. 31, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to an image forming apparatus that is equipped with an improved developer detecting device and agitating device mounted to a developer storage part.

2. Description of the Related Art

Generally, an image forming apparatus is an apparatus that prints an image on a printing medium, e.g., paper, according to an input image signal. As one example of the image forming apparatus, an electrophotographic image forming apparatus is configured such that a light beam is scanned onto a photosensitive member charged with an electric potential to form an electrostatic latent image thereon, and then the electrostatic latent image is developed to a visible image by adhering a developer onto the electrostatic latent image, and the visible image is then transferred and fixed onto paper.

In such a printing process, a developer contained in a developing device of an image forming apparatus is regularly consumed. If the developer is totally consumed, a user replaces the developing device itself or a developer cartridge in the developing device. So as to enable the user to replace the developing device or the developer cartridge at the right time, the developing device is typically provided with a developer detecting device for detecting an amount of developer remaining. Japanese Patent Laid-open Publication No. 2004-61971 discloses one example of a conventional image forming apparatus with a developer detecting device.

The conventional image forming apparatus includes a light emitting part, a light receiving part, and two optical fibers which guide light emitted from the light emitting part to the light receiving part. The light emitting part and the light receiving part are mounted in a main body of the image forming apparatus, and the optical fibers are mounted in a developing device. One optical fiber is connected to the light emitting part, the other optical fiber is connected to the light receiving part, and a developer detecting part for detecting an amount of developer is interposed between the two optical fibers. If the light emitted from the light emitting part is blocked by the developer filled in the developer detecting part and cannot be transmitted to the light receiving part, it is determined that sufficient developer remains. On the other hand, if the light emitted from the light emitting part is transmitted to the light receiving part through the developer detecting part and the optical fibers, it is determined that the developer is almost exhausted.

The above conventional image forming apparatus can prevent a decrease of light intensity in the developing device by using the optical fibers. However, because the optical fiber is expensive, it is not economical.

Also, the developing device is typically provided with an agitating device for agitating the developer therein. However, the conventional image forming apparatus has difficulty in arranging optical fibers and optical fiber supporting members without interference with the agitating device.

The visible image developed on the photosensitive member is transferred to the paper directly or via an intermediate transfer device. When the visible image is transferred to the paper or to the intermediate transfer device from the photosensitive member, or when the visible image is transferred to the paper from the intermediate transfer device, the image is not totally transferred, but instead a portion of the developer remains on the photosensitive member or the intermediate transfer device. The residual waste developer is collected by a waste developer collecting device, and is stored in a waste developer container.

If the waste developer container is filled with the waste developer, the user replaces the waste developer container. Similarly to the developing device, so as to enable the user to replace the waste developer container at the right time, the waste developer container is typically provided with a waste developer detecting device.

Korean Patent Laid-open Publication No. 2006-0037955 discloses a device for detecting an amount of waste developer stored in a waste developer container. The conventional waste developer detecting device includes a light emitting part and a light receiving part disposed opposite to the light emitting part. When the light receiving part cannot receive the light from the light emitting part, it is determined that the waste developer is stored in the waste developer container above a predetermined amount.

However, the conventional image forming apparatus equipped with the above conventional waste developer detecting device alerts a user to replace the waste developer container just before the waste developer container is full of waste developer. Therefore, unless the user prepares a new waste developer container in advance, the user cannot use the image forming apparatus until preparing a new waste developer container.

Considering the above problem, a plurality of light emitting parts positioned at different heights and a plurality of light receiving parts corresponding to the respective light emitting parts may be provided, so as to inform the user of the amount of waste developer stored in the waste developer container by stages. However, it causes an increase in manufacturing costs due to the increased number of the light emitting parts and the light receiving parts.

SUMMARY OF THE INVENTION

The present general inventive concept provides an image forming apparatus that is equipped with an improved developer detecting device and agitating device to simplify the inner structure of a developing device or a waste developer container while reducing the number of components and costs.

The present general inventive concept provides an image forming apparatus that is capable of checking an amount of waste developer stored in a developing device or a waste developer container by stages.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus including a developer storage part to store a developer, a light emitting part and a light receiving part which are provided to detect an amount of developer stored in the developer storage part, including a rotating unit which rotates to agitate the developer stored in the developer storage part and guides light emitted from the light emitting part to the light receiving part.

The rotating unit may include a rotating shaft portion and an extending portion which extends eccentrically from the rotating shaft portion.

The rotating unit may include a first rotating shaft portion which has an end disposed opposite to the light emitting part, and a second rotating shaft portion which has an end disposed opposite to the light receiving part.

The rotating unit may further include a first extending portion which extends from the first rotating shaft portion, and a second extending portion which extends from the second rotating shaft portion. The first extending portion and the second extending portion oppose each other and define a developer detecting region therebetween.

The rotating shaft portion and the extending portion are made of a transparent material.

The rotating unit may include a reflecting portion which reflects light moving from the light emitting part to the light receiving part.

The rotating unit may include a hollow member, and light emitted from the light emitting part is guided to the light receiving part through an interior of the hollow member. Preferably, the hollow member includes a reflecting surface which is formed on an inner surface.

The image forming apparatus may further include a developer inflow-prevention member which is mounted to an end of the hollow member to prevent inflow of the developer into the hollow member. The developer inflow-prevention member is made of a transparent material that light passing through the interior of the hollow member can permeate.

The image forming apparatus may further include a cleaning member which cleans end surfaces of the first extending portion and the second extending portion which define the developer detecting region.

The image forming apparatus may further include an agitating member which is connected to the first rotating shaft portion at one side and connected to the second rotating shaft portion at the other side to rotate together with the rotating unit.

The image forming apparatus may further include a photosensitive member on which an electrostatic latent image is formed according to image information. The developer to be supplied to the photosensitive member is stored in the developer storage part. The developer storage part may include a waste developer container in which waste developer is stored.

The foregoing and/or other aspects and utilities of the present general inventive concept may also be achieved by providing an image forming apparatus including a developer storage part to store a developer, a light emitting part and a light receiving part which are provided to detect an amount of developer stored in the developer storage part, and an agitating device which agitates the developer stored in the developer storage part, being characterized in that: the agitating device includes a light guide part which guides light emitted from the light emitting part to the light receiving part.

The light guide part may include a first rotating member which has an end disposed opposite to the light emitting part, and a second rotating member which has an end disposed opposite to the light receiving part. The first rotating member and the second rotating member have the other ends which oppose each other to define a developer detecting region therebetween.

The developer detecting region is positioned at a distance from a rotating axis of the first rotating member and the second rotating member in a radial direction.

The first rotating member and the second rotating member may be made of a transparent material.

The image forming apparatus may further include a cleaning member which cleans surfaces of the other ends of the first rotating member and the second rotating member which define the developer detecting region.

The light guide part may include a hollow member, and light emitted from the light emitting part is transmitted to the light receiving part through an interior of the hollow member.

The first rotating member and the second rotating member may include reflecting surfaces which are provided at bent portions of the first rotating member and the second rotating member.

The agitating device may further include an agitating member connected to the first rotating member at one side and connected to the second rotating member at the other side to rotate together with the first rotating member and the second rotating member.

The developer to be supplied to the photosensitive member may be stored in the developer storage part. The developer storage part may include a waste developer container in which waste developer is stored.

The foregoing and/or other aspects and utilities of the present general inventive concept may also be achieved by providing a developer container, comprising: a developer housing; rotating unit extending from one side of the housing to an opposite side thereof, the rotating unit including a first rotating shaft portion extending at a first end from the one side of the housing and having an eccentric shape and a second rotating shaft portion extending at a first end from the opposite side of the housing and having an eccentric shape such that a second end of the first and second rotating shaft portions face each other and have a gap therebetween, wherein one of the first and second rotating shaft portions receives light from a light emitting unit and transmits the light to the other of the first and second rotating shaft portions to transmit the light to a light receiving unit in order to determine an amount of developer in the developer housing.

The developer container may further comprise a cleaning member disposed at one or both of a bottom portion and a top portion of the developer housing such that second ends of both of the first and second rotating shaft portions are cleaned thereby during agitating of the developer The developing container may further comprise a rectangular frame formed integrally with the first and second rotating shaft portions.

The foregoing and/or other aspects and utilities of the present general inventive concept may also be achieved by providing an image forming apparatus, comprising: a developer storage container including: a housing, an agitating member extending from one side of the housing to an opposite side thereof, the agitating member including a first rotating shaft portion extending at a first end from the one side of the housing and having an eccentric shape and a second rotating shaft portion extending at a first end from the opposite side of the housing and having an eccentric shape such that a second end of the first and second rotating shaft portions face each other and have a gap therebetween, wherein one of the first and second rotating members receives light at the first end thereof and emits the light at the second end thereof to the other of the first and second rotating members at the second end thereof, which transmits the light out of the first end thereof; and a light emitting unit to supply the light to one end of the agitator and a light receiving unit to receive light from the other end of the agitator to detect an amount of developer stored in the developer storage container.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
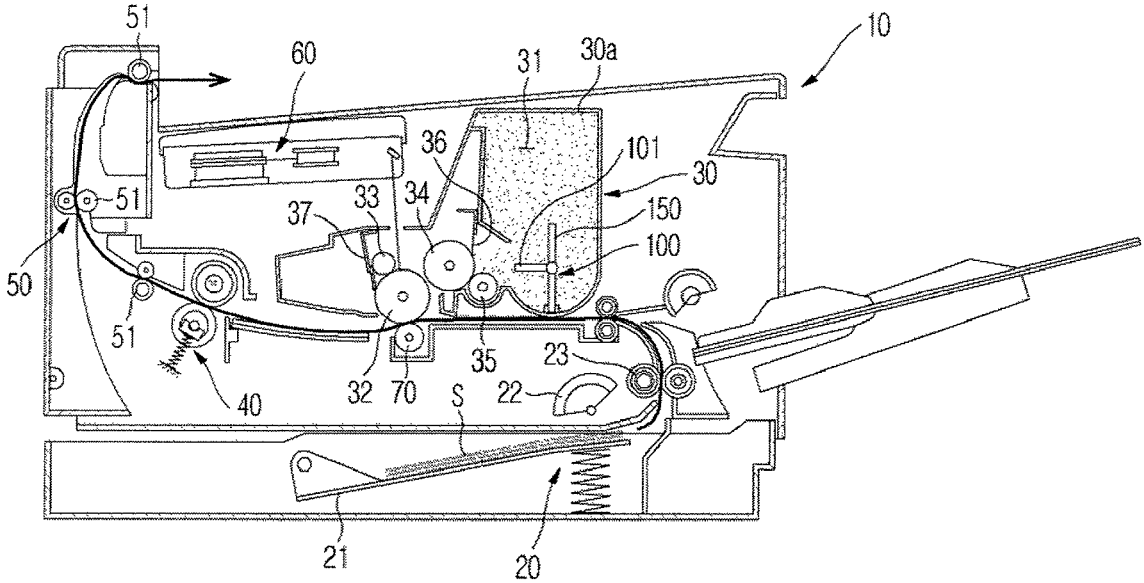
FIG. 1 is a sectional view illustrating the constitution of an image forming apparatus in accordance with an embodiment of the present general inventive concept.

Reference will now be made in detail to the embodiments of the present general inventive concept, examples of which are illustrated in the accompanying drawings, wherein like reference numerals refer to like elements throughout. The embodiments are described below to explain the present general inventive concept by referring to the figures.

FIG. 1 is a sectional view illustrating an image forming apparatus in accordance with an embodiment of the present general inventive concept.

As illustrated in FIG. 1, the image forming apparatus according to this embodiment includes a main body 10 which forms an exterior appearance and supports components accommodated therein, a paper feeding unit 20 to supply a printing medium, e.g., paper S, a developing unit 30 to develop images on the paper, a fixing unit 40 to fix the images on the paper by applying heat and pressure to the paper, and a paper discharge unit 50 to discharge the printed paper to the exterior of the main body 10.

The paper feeding unit 20 includes a paper tray 21 on which the paper S is loaded, a pickup roller 22 which picks up the paper S loaded on the paper tray 21 sheet by sheet, and a feed roller 23 which feeds the picked-up paper toward the developing unit 30.

The developing unit 30 includes a housing 30*a* having a developer storage part 31 to store a developer. The housing 30*a* accommodates a photosensitive member 32 on which an electrostatic latent image is formed by an exposure unit 60 according to image information, a charge roller 33 to charge the surface of the photosensitive member 32 with a predetermined electric potential, an agitating device 100 which is mounted to a lower portion of the developer storage part 31 to agitate the developer stored in the developer storage part 31 so that the developer does not solidify, a developing roller 34 which develops the electrostatic latent image formed on the photosensitive member 32 to a visible image, and a supply roller 35 which rotates while contacting the developing roller 34 to supply the developer stored in the developer storage part 31 to the developing roller 34.

The housing 30*a* further accommodates a restriction blade 36 and a cleaning blade 37. The restriction blade 36 restricts a thickness of the developer adhered to the surface of the developing roller 34 by the supply roller 35. The cleaning blade 37 removes the developer which is not transferred to the paper and remains on the surface of the photosensitive member 32.

The image forming apparatus further includes a transfer roller 70 which is disposed opposite to the photosensitive member 32 inside the main body 10. While the paper passes between the photosensitive member 32 and the transfer roller 70, the developed image on the photosensitive member 32 is transferred to the paper. While the paper passes through the fixing unit 40, the developer image transferred to the paper is fixed to the paper. The printed paper having passed through the fixing device 40 is discharged to the exterior of the main body 10 by discharge rollers 51.

The image forming apparatus further includes a developer detecting device to detect an amount of developer stored in the developer storage part 31 of the developing unit 30. The developer detecting device provides the user with information on whether the developer storage part 31 is depleted of the developer, and accordingly enables the user to replace the developing unit 30 at the right time.

Figure 2:
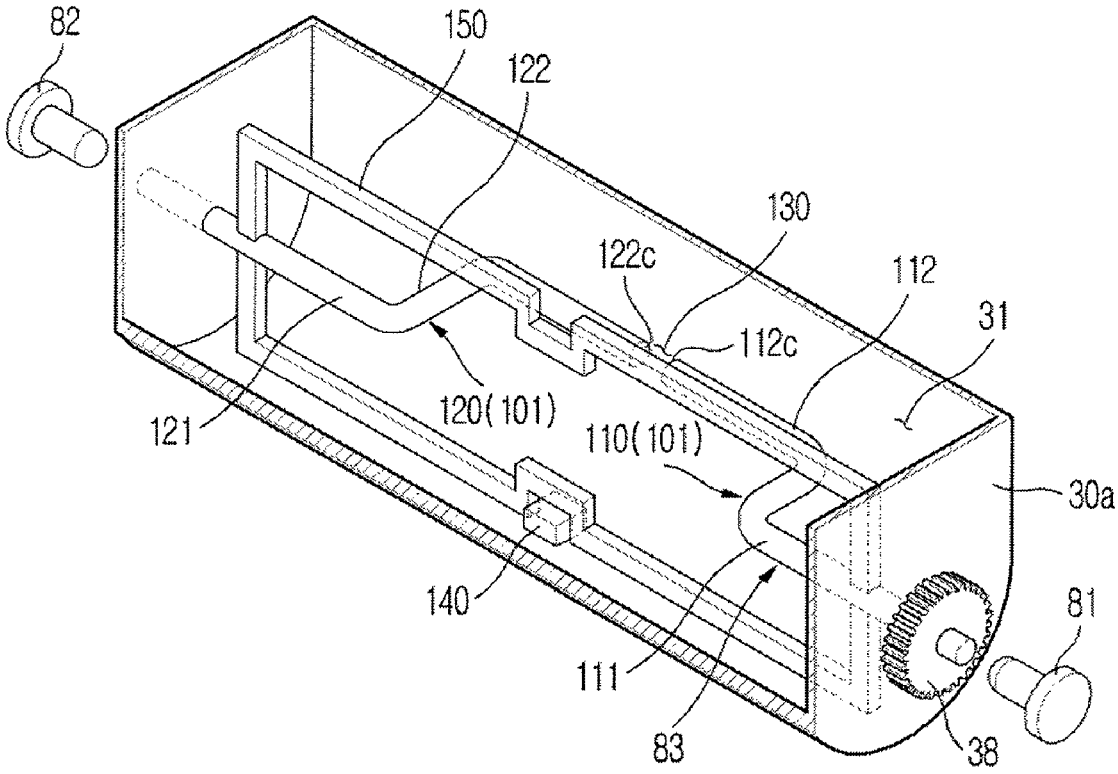
FIG. 2 is a perspective view illustrating a developer detecting device and an agitating device of the image forming apparatus depicted in FIG. 1.
Figure 3:
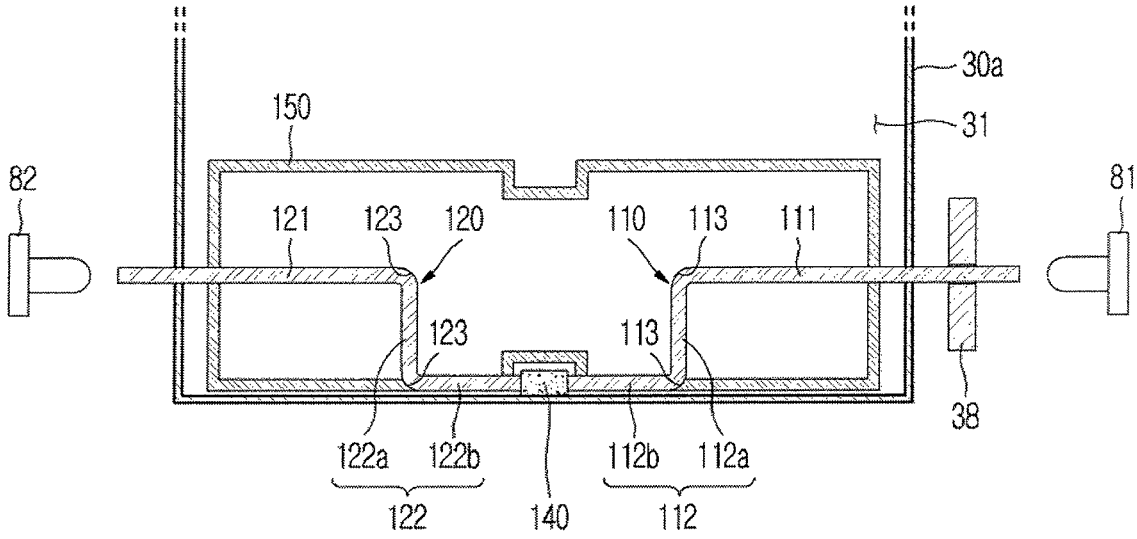
FIG. 3 is a sectional view illustrating a developer detecting device and an agitating device of the image forming apparatus depicted in FIG. 1.

FIGS. 2 and 3 are a perspective view and a sectional view illustrating the developer detecting device and the agitating device of the image forming apparatus depicted in FIG. 1, respectively. For convenience in the illustration, a rotation phase of a rotating unit depicted in FIG. 3 is different from that depicted in FIG. 2.

As illustrated in the drawings, the developer detecting device may include a light emitting part 81 and a light receiving part 82 which are mounted to the main body 10. The light emitting part 81 and the light receiving part 82 are disposed opposite to each other while interposing the developer storage part 31 therebetween. The light emitting part 81 irradiates light into the developer storage part 31, and the light receiving part 82 receives the light emitted from the light emitting part 81 and provides the information of the amount of developer remaining in the developer storage part 31.

Between the light emitting part 81 and the light receiving part 82 is a light guide part 83 which guides the light emitted from the light emitting part 81 to the light receiving part 82. In this embodiment, the light guide part 83 also serves as an element constituting the agitating device 100. As such, when the light guide part 83 is used in both the developer detecting device and the agitating device 100, manufacturing costs are reduced. In addition, since the number of elements mounted to the developer storage part 31 decreases, the developing unit can be manufactured more compactly.

The agitating device 100 includes a rotating unit 101 which rotates inside the developer storage part 31 to agitate the developer stored in the developer storage part 31 and guides the light emitted from the light emitting part 81 to the light receiving part 82. The rotating unit 101 has a pair of rotating members 110 and 120 which are rotatably supported by the housing 30*a* of the developing device 30.

One rotating member 110 extends from the housing 30*a* to the exterior such that an end opposes the light emitting part 81 in an axial direction. The other rotating member 120 extends from the housing 30*a* to the exterior such that an end opposes the light receiving part 82 in an axial direction. Hereinafter, the rotating member 110 opposing the light emitting part 81 will be called a first rotating member, and the rotating member 120 opposing the light receiving part 82 will be called a second rotating member.

The end portion of the first rotating member 110 extending to the exterior of the housing 30*a* is provided with a driving gear 38. The driving gear 38 receives a driving force from a driving source (not shown) and rotates the first rotating member 110. When the first rotating member 110 rotates, the second rotating member 120, which is connected to the first rotating member 110 by an agitating member 150, also rotates.

The first rotating member 110 has a rotating shaft portion 111 which is arranged along the rotational axis, and an extending portion 112 which extends eccentrically from the rotating shaft portion 111. Similarly, the second rotating member 120 has a rotating shaft portion 121 which is arranged along the rotational axis, and an extending portion 122 which extends eccentrically from the rotating shaft portion 121. The extending portions 112 and 122 function to guide the light emitted from the light emitting part 81 and to agitate the developer in the developer storage part 31 while rotating about the rotating shaft portions 111 and 121.

It is depicted in FIGS. 2 and 3 that the extending portions 112 and 122 have first bending portions 112*a* and 122*a* which are bent from the rotating shaft portions 111 and 121 and extend along the radial direction and second bending portions 112*b* and 122*b* which are bent from the first bending portions 112*a* and 122*a* and extend along the axial direction. However, the shapes of the extending portions 112 and 122 can be changed. For example, the extending portions 112 and 122 may have an arc shape. Hereinafter, the rotating shaft portion 111 and the extending portion 112 of the first rotating member 110 will be respectively called a first rotating shaft portion 111 and a first extending portion 112, and the rotating shaft portion 121 and the extending portion 122 of the second rotating member 120 will be respectively called a second rotating shaft portion 121 and a second extending portion 122.

The first extending portion 112 and the second extending portion 122 oppose each other, and define a developer detecting region 130 therebetween. Because the developer detecting region 130 is defined between the first extending portion 112 and the second extending portion 122, which eccentrically extend from the first rotating shaft portion 111 and the second rotating shaft portion 121, respectively, the developer detecting region 130 is positioned at a predetermined distance from the rotating shaft portions 111 and 121 in the radial direction. Such a structure can detect more precisely the amount of developer left in the developer storage part 31. The detecting operation will be described later.

The developer detecting region 130 is a space that is formed between the first extending portion 112 and the second extending portion 122. If the developer exists in the developer detecting region 130, the light emitted from the light emitting part 81 cannot pass through the developer detecting region 130 and cannot be transmitted to the light receiving part 82. On the other hand, if the developer does not exist in the developer detecting region 130, the light emitted from the light emitting part 81 can pass through the developer detecting region 130 and can be transmitted to the light receiving part 82.

The first rotating member 110 and the second rotating member 120 are made of a transparent material so that the light emitted from the light emitting part 81 can be guided to the light receiving part 82 through the first rotating member 110 and the second rotating member 120. For example, the first rotating member 110 and the second rotating member 120 can be made of acrylic. Also, it is preferred that the rotating members 110 and 120 have reflecting portions 113 and 123 to reflect the light emitted from the light emitting part 81. The reflecting portions 113 of the first rotating member 110 are provided at the junction of the first rotating shaft portion 111 and the first bending portion 112*a* and at the junction of the first bending portion 112*a* and the second bending portion 112*b*, and the reflecting portions 123 of the second rotating member 120 are provided at the junction of the second rotating shaft portion 121 and the first bending portion 122*a* and at the junction of the first bending portion 122*a* and the second bending portion 122*b*. Accordingly, the light emitted from the light emitting part 81 can be smoothly guided to the light receiving part 82 through the first rotating member 110 and the second rotating member 120. It is to be noted that other types of members than the reflecting portions 113 and 123, which will pass the light along the rotating members according to the intended purposes of the invention as described herein, can be used alternatively.

A cleaning member 140 is attached to a bottom of the developer storage part 31 to clean end surfaces 112*c* and 122*c* of the first extending portion 112 and the second extending portion 122, respectively, which form the developer detecting region 130. When the first rotating member 110 and the second rotating member 120 rotate, the end surface 112*c* of the first extending portion 112 and the end surface 122*c* of the second extending portion 122 are cleaned by friction with the cleaning member 140.

The agitating device 100 further includes the agitating member 150 that rotates together with the rotating unit 101 and agitates the developer stored in the developer storage part 31. It is depicted in FIGS. 2 and 3 that the agitating member 150 is configured as a rectangular frame, however the shape of the agitating member 150 can be adjusted as needed in design. One side portion of the agitating member 150 is connected to the first rotating shaft portion 111, and the opposite side portion of the agitating member 150 is connected to the second rotating shaft portion 121. Accordingly, when the first rotating member 110 connected to the driving gear 38 rotates, the second rotating member 120, which is connected to the first rotating member 110 by the agitating member 150, also rotates at the same speed as the first rotating member 110.

Hereinafter, the operation of detecting the amount of developer stored in the developer storage part will be described with reference to FIGS. 4A through 4D. In FIGS. 4A through 4D, a reference character "T" refers to time, and a reference character "Q" refers to a light intensity detected from the light receiving part 82. For convenience in the illustration, the agitating member 150 is not depicted in FIGS. 4A through 4D.

During a printing operation of the image forming apparatus, the rotating unit 101 and the agitating member 150 rotate inside the developer storage part 31 to agitate the developer. When the rotating unit 101 rotates, the developer detecting region 130 defined between the first rotating member 110 and the second rotating member 120 moves upward and downward.

Also, when the rotating unit 101 rotates, the light emitting part 81 emits the light along the axial direction of the first rotating member 110.

Figure 4A:
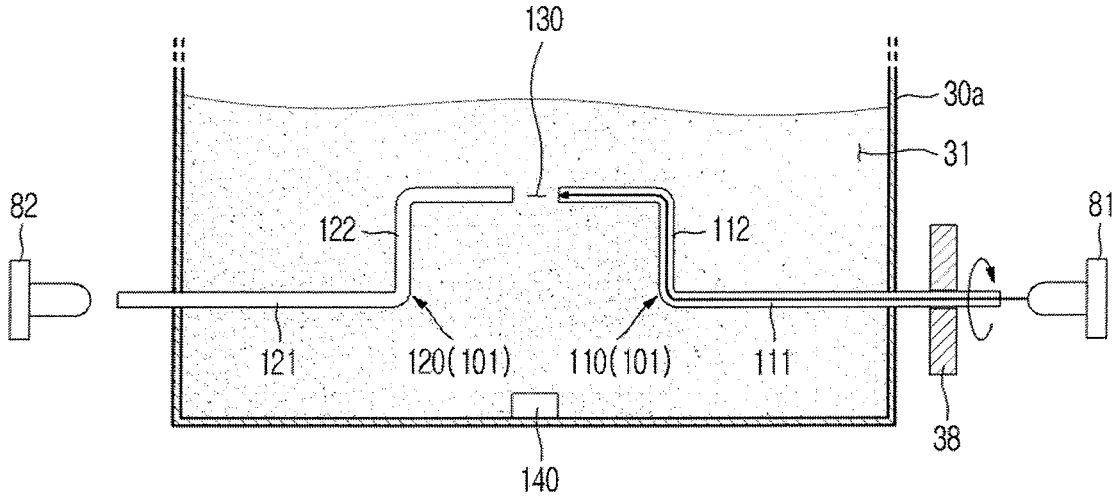
FIG. 4 is a view illustrating the operation of detecting an amount of developer stored in a developer storage part of the image forming apparatus depicted in FIG. 1.
Figure 4A:
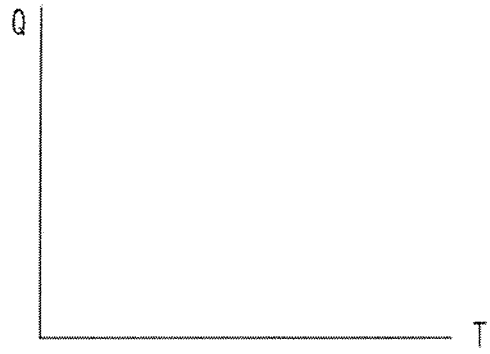

As illustrated in FIG. 4A, when the developer remains sufficiently in the developer storage part 31, the developer detecting region 130 is not exposed to an exterior of the developer in spite of the rotation of the rotating unit 101.

Accordingly, the light emitted from the light emitting part 81 and guided along the first rotating shaft portion 111 and the extending portion 112 of the first rotating member 110 is blocked by the developer existing in the developer detecting region 130 and cannot be transmitted to the light receiving part 82. In other words, as illustrated by a graph in FIG. 4A, the light receiving part 82 does not receive the light emitted from the light emitting part 81.

Figure 4B:
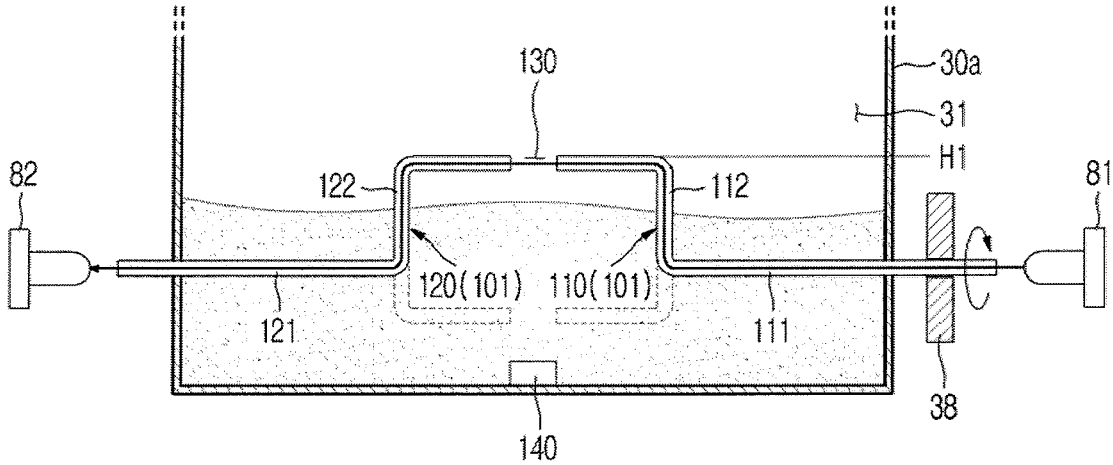
Figure 4B:
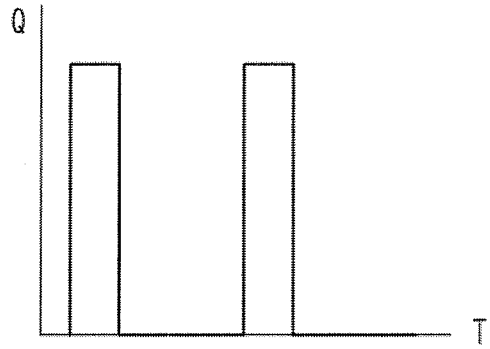

As the printing operation further proceeds, when the developer is consumed to a height below a top position H1 of the developer detecting region 130 as illustrated in FIG. 4B, the developer detecting region 130 is exposed to the exterior of the developer at a partial section (as Illustrated by a real line in FIG. 4B) while the rotating unit 101 rotates. While the developer detecting region 130 is exposed to the exterior of the developer, the light emitted from the light emitting part 81 passes through the developer detecting region 130 and is transmitted to the second rotating member 120. The light transmitted to the second rotating member 120 is guided along the second extending portion 122 and the second rotating shaft portion 121 and arrives at the light receiving part 82. Accordingly, as illustrated by a graph in FIG. 4B, the light receiving part 82 receives the light within a specific time zone. On the other hand, when the developer detecting region 130 is located in the developer as illustrated by a dotted line in FIG. 4B, because the light from the light emitting part 81 is blocked by the developer, the light receiving part 82 does not receive the light.

Figure 4C:
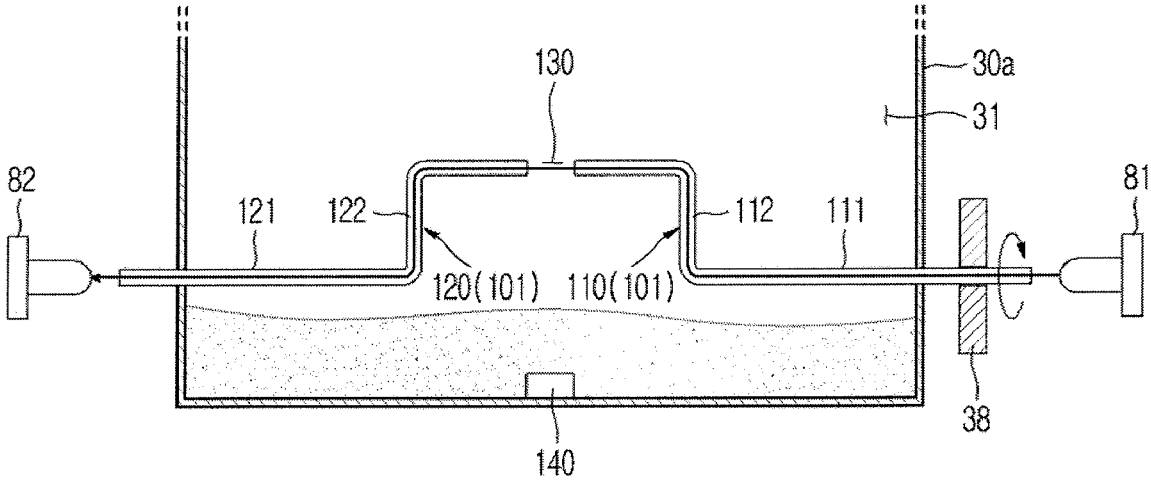
Figure 4C:
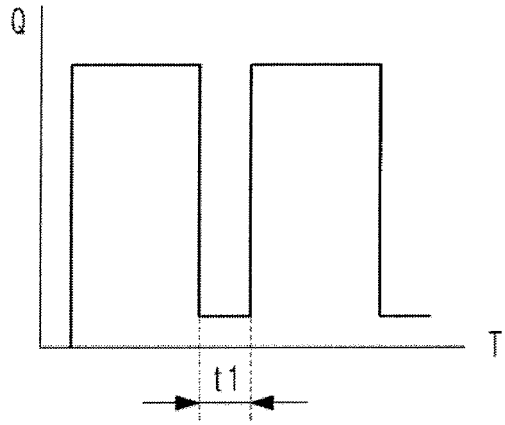

When the developer is further consumed to a height below the rotating shaft portions 111 and 121 of the rotating members 110 and 120 as illustrated in FIG. 4C, the developer detecting region 130 is exposed to the exterior of the developer for a longer time period while the rotating unit 101 rotates. Accordingly, the light receiving part 82 receives the light for a longer period of time than the state in FIG. 4D. A "t1" in a graph in FIG. 4C refers to a time period when the developer detecting region 130 is located in the developer. The reason that the small light intensity is detected from the light receiving part 82 for the time "t1" is that a condition in which the light going straight from the first rotating shaft portion 111 to the second rotating shaft portion 121 exists.

Figure 4D:
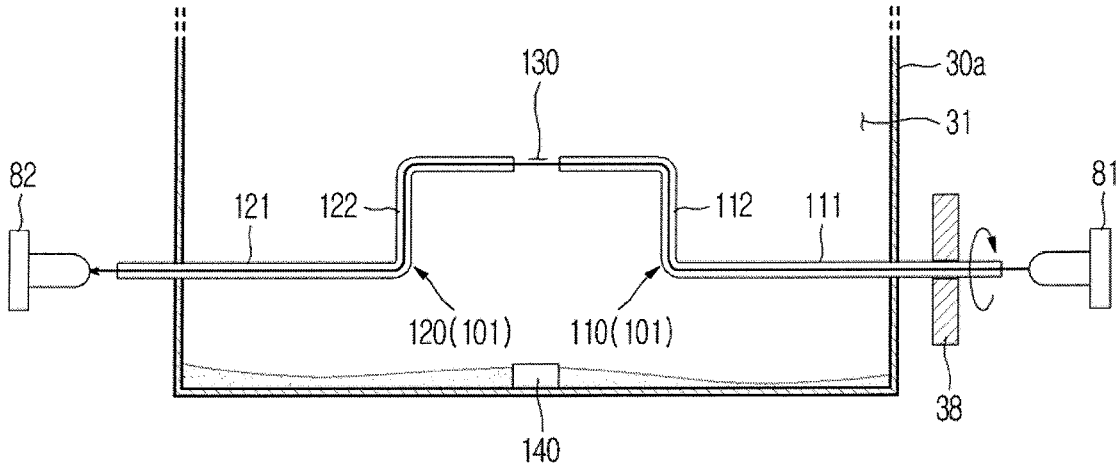
Figure 4D:
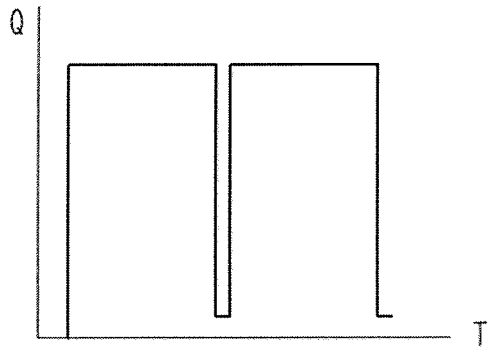

When the developer is almost exhausted to the bottom of the developer storage part 31 as illustrated in FIG. 4D, the light is transmitted to the light receiving part 82 through the developer detecting region 130 for a longer period of time while the rotating unit 101 rotates. Accordingly, the light receiving part 82 receives the light within the longest period of time. However, the light receiving part 82 does not receive the light within a partial time period as illustrated by a graph in FIG. 4D. This is because the light is blocked by the cleaning member 140 when the developer detecting region 130 passes by the cleaning member 140.

As described above, the amount of developer left in the developer storage part 31 can be precisely determined by determining whether the light is detected from the light receiving part and analyzing the light detecting pattern.

Figure 5:
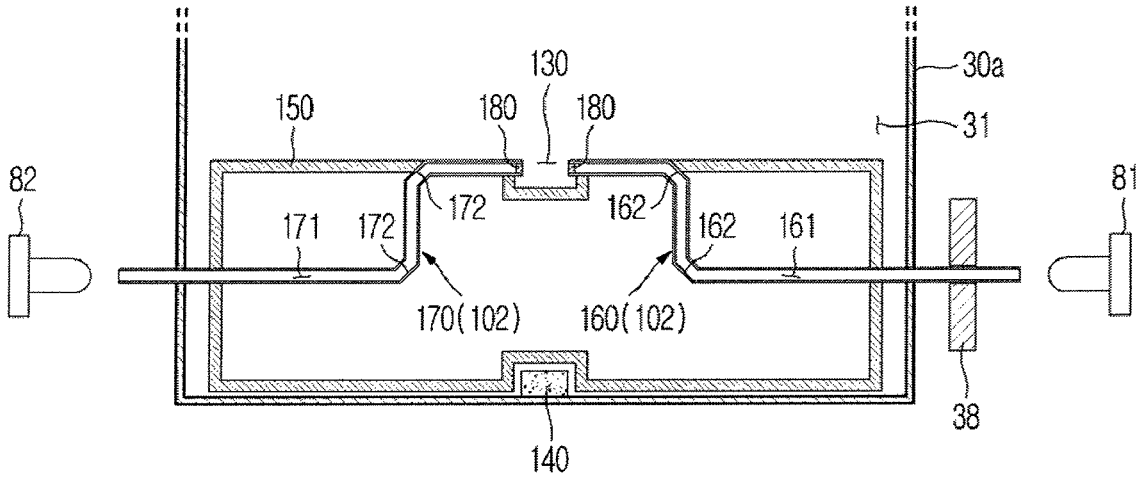
FIG. 5 is a sectional view illustrating a developer detecting device and an agitating device of an image forming apparatus in accordance with another embodiment.

FIG. 5 is a sectional view illustrating a developer detecting device and an agitating device of an image forming apparatus in accordance with another embodiment of the present general inventive concept. In the following description, only the structural features of this embodiment will be described. The same elements as the previous embodiment illustrated in FIG. 3 are denoted by the same reference numerals.

As illustrated in FIG. 5, a first rotating member 160 and a second rotating member 170 of a rotating unit 102 are formed in a hollow body having empty spaces 161 and 171. The light emitted from the light emitting part 81 is guided to the light receiving part 82 through the empty spaces 161 and 171 of the first and second rotating members 160 and 170. In order to smoothly guide the light passing through the hollow rotating members 160 and 170 to the light receiving part 82, the rotating members 160 and 170 are formed with reflecting surfaces 162 and 172 at the inner surfaces of the bent portions.

The first and second rotating members 160 and 170 can be made of a metal material having sufficient reflectability so that the light is reflected well within the rotating members 160 and 170. Also, the reflecting surfaces 162 and 172 may be applied with a reflective coating to increase the reflectability. The end portions of the first and second rotating members 160 and 170, which are disposed opposite to each other to define the developer detecting region 130, are provided with developer inflow-prevention members 180. The developer inflow-prevention members 180 block the end portions of the first and second rotating members 160 and 170 to prevent the inflow of the developer into the rotating members 160 and 170. The developer inflow-prevention members 180 are made of a transparent material that light can permeate.

Since the operation of this embodiment can be sufficiently anticipated from that of the previous embodiment illustrated in FIG. 4, the description thereof will be omitted.

Figure 6:
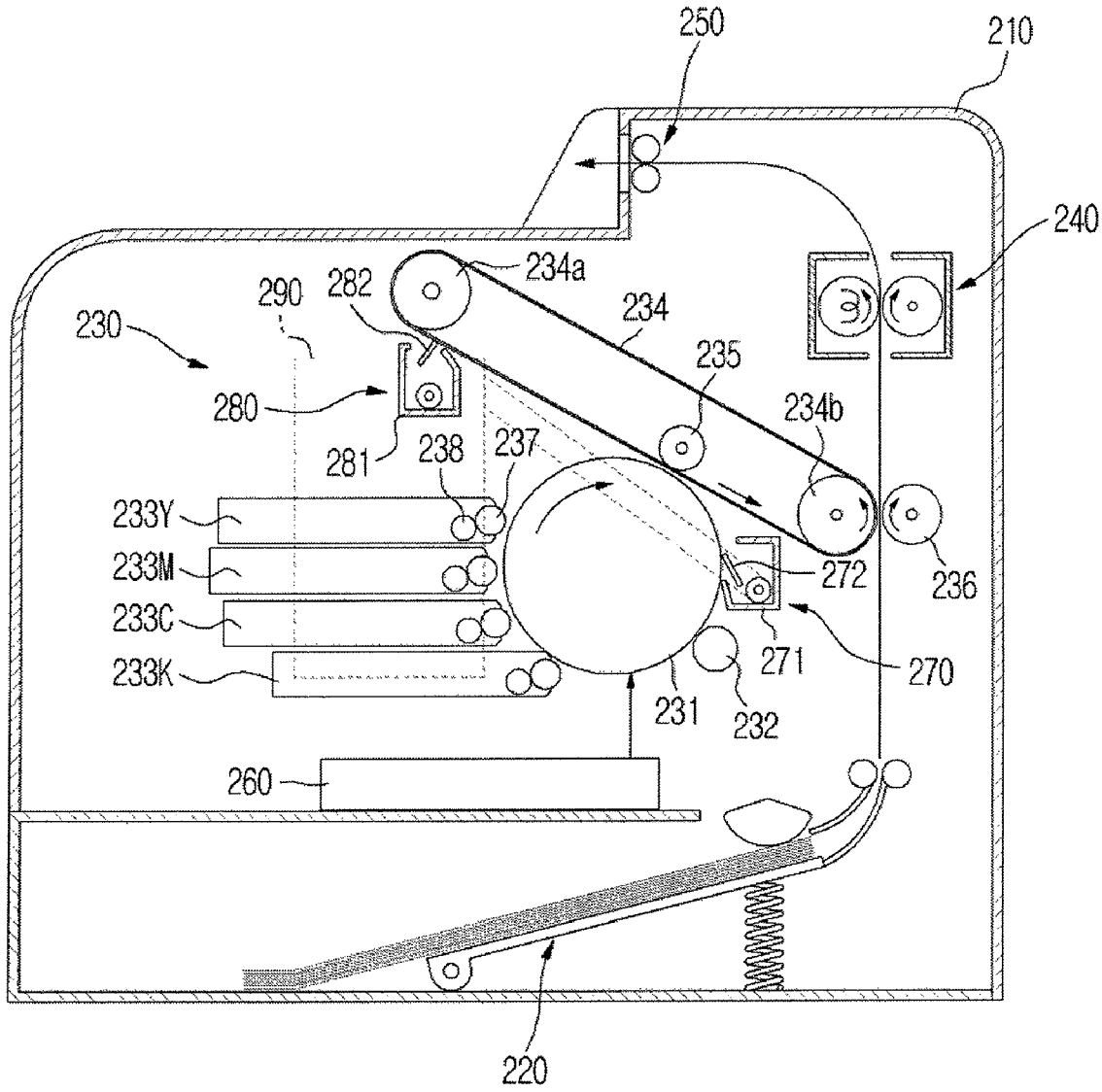
FIG. 6 is a sectional view illustrating the constitution of an image forming apparatus in accordance with a third embodiment of the present invention.
Figure 7:
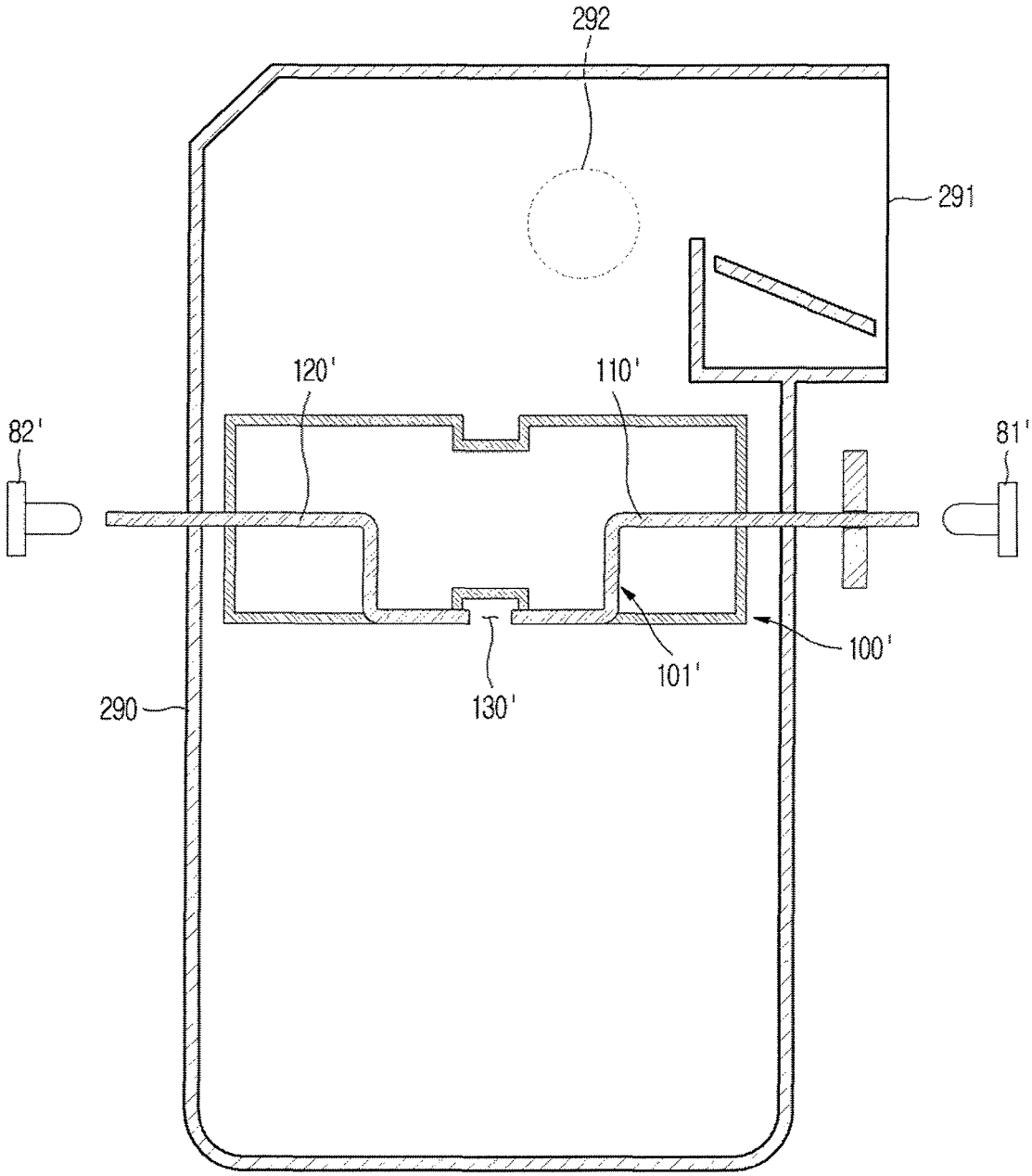
FIG. 7 is a sectional view illustrating a waste developer container, a developer detecting device, and an agitating device of the image forming apparatus depicted in FIG. 6.

FIG. 6 is a sectional view illustrating the constitution of an image forming apparatus in accordance with yet another embodiment, and FIG. 7 is a sectional view illustrating a waste developer container, a developer detecting device, and an agitating device of the image forming apparatus depicted in FIG. 6. A feature of the embodiment of FIG. 6 alternative to the embodiment illustrated in FIG. 1 is that the developer detecting device detects the amount of waste developer. Hereinafter, the characteristics of this embodiment will be primarily described.

As illustrated in FIG. 6, the image forming apparatus of this embodiment includes a main body 210, a paper feeding unit 220, a developing unit 230, a fixing unit 240, and a paper discharge unit 250.

The developing unit 230 includes a photosensitive member 231 on which an electrostatic latent image is formed by an exposure unit 260 according to image information, a charge roller 232 to charge the photosensitive member 231, four developing devices 233Y, 233M, 233C and 233K which develop the electrostatic latent image formed on the photosensitive member 231 to a visible image by using yellow, magenta, cyan and black developer, an intermediate transfer belt 234, a first transfer roller 235, and a second transfer roller 236.

Each of the developing devices 233Y, 233M, 233C and 233K includes a developing roller 237 which develops the electrostatic latent image formed on the photosensitive member 231 by supplying the developer, and a supply roller 238 which rotates while contacting the developing roller 237 to supply the developer to the developing roller 237.

The intermediate transfer belt 234 is supported by support rollers 234*a* and 234*b*, so as to run at the same linear velocity as the rotational velocity of the photosensitive member 231. The first transfer roller 235 is disposed opposite to the photosensitive member 231, and transfers the visible image developed on the photosensitive member 231 to the intermediate transfer belt 234. The second transfer roller 236 is disposed opposite to the intermediate transfer belt 234. While the image is transferred to the intermediate transfer belt 234 from the photosensitive member 231, the second transfer roller 236 is spaced apart from the intermediate transfer belt 234. When the image is completely transferred to the intermediate transfer belt 234, the second transfer roller 236 comes into contact with the intermediate transfer belt 234 with a predetermined pressure. When the second transfer roller 236 contacts the intermediate transfer belt 234, the image of the intermediate transfer belt 234 is transferred to the paper.

In the process of transferring the image to the photosensitive member 231, the intermediate transfer belt 234, and the paper, a portion of the developer remains on the photosensitive member 231 or the intermediate transfer belt 234. In order to print the following sheet of paper, the residual waste developer on the photosensitive member 231 and the intermediate transfer belt 234 must be removed. To this end, the image forming apparatus includes a first cleaning unit 270, a second cleaning unit 280, and a waste developer container 290 which is a waste developer storage part to store the waste developer collected from the photosensitive member 231 and the intermediate transfer belt 234.

The first cleaning unit 270 can remove the waste developer from the photosensitive member 231. The first cleaning unit 270 includes a waste developer collecting case 271, a cleaning blade 272 which rakes out the waste developer from the photosensitive member 231, and a transfer device (not shown) which transfers the waste developer collected in the waste developer collecting case 271 to the waste developer container 290. The transfer device may be configured as an auger that has a spiral blade and transfers the waste developer by the rotation. The second cleaning unit 280 can remove the waste developer from the intermediate transfer belt 234. Similarly to the first cleaning unit 270, the second cleaning unit 280 includes a waste developer collecting case 281 and a cleaning blade 282. The waste developer collected in the waste developer collecting case 281 of the second cleaning unit 280 is also transferred to the waste developer container 290 by the transfer device. The waste developer transferred from the first cleaning unit 270 and the second cleaning unit 280 drops freely by gravity and accumulates in the waste developer container 290.

As illustrated in FIGS. 6 and 7, the waste developer container 290 is detachably mounted to the inner surface of the main body 210. A first inlet port 291 and a second inlet port 292, through which the waste developer transferred from the first cleaning unit 270 and the second cleaning unit 280 is respectively put into the waste developer container 290, are formed at an upper portion of the waste developer container 290. An agitating device 100' is mounted inside the waste developer container 290. The agitating device 100' prevents the waste developer stored in the waste developer container 290 from being solidified and evenly disperses the waste developer so that the waste developer is not concentrated at a specific portion.

The image forming apparatus of this embodiment further includes a developer detecting device to detect the amount of waste developer stored in the waste developer container 290. The developer detecting device gives the user information of the amount of waste developer stored in the waste developer container 290, and accordingly enables the user to replace the waste developer container 290 at the right time.

The developer detecting device includes a light emitting part 81' and a light receiving part 82' which are mounted to the main body 210. The light emitting part 81' and the light receiving part 82' are disposed opposite to each other while interposing the waste developer container 290 therebetween. The light emitting part 81' irradiates light into the waste developer container 290, and the light receiving part 82' receives the light emitted from the light emitting part 81' and provides the information of the amount of developer accumulated in the waste developer container 290.

Since the overall constitution of the developer detecting device is similar to that of the developer detecting device depicted in FIG. 3, the detailed description thereof will be omitted. However, the developer detecting device depicted in FIG. 3 detects the amount of developer that is gradually consumed in the developing device, and accordingly the rotating unit 101 is mounted near the bottom of the developer storage part 31. On the other hand, the developer detecting device of this embodiment detects the amount of developer that is gradually accumulated in the waste developer container 290, and accordingly the rotating unit 101' is mounted at a predetermined distance from the bottom of the waste developer container 290.

Hereinafter, the operation of detecting the amount of developer stored in the waste developer container in this embodiment will be described with reference to FIG. 8. For convenience in the illustration, the agitating member is not depicted in FIG. 8.

Figure 8A:
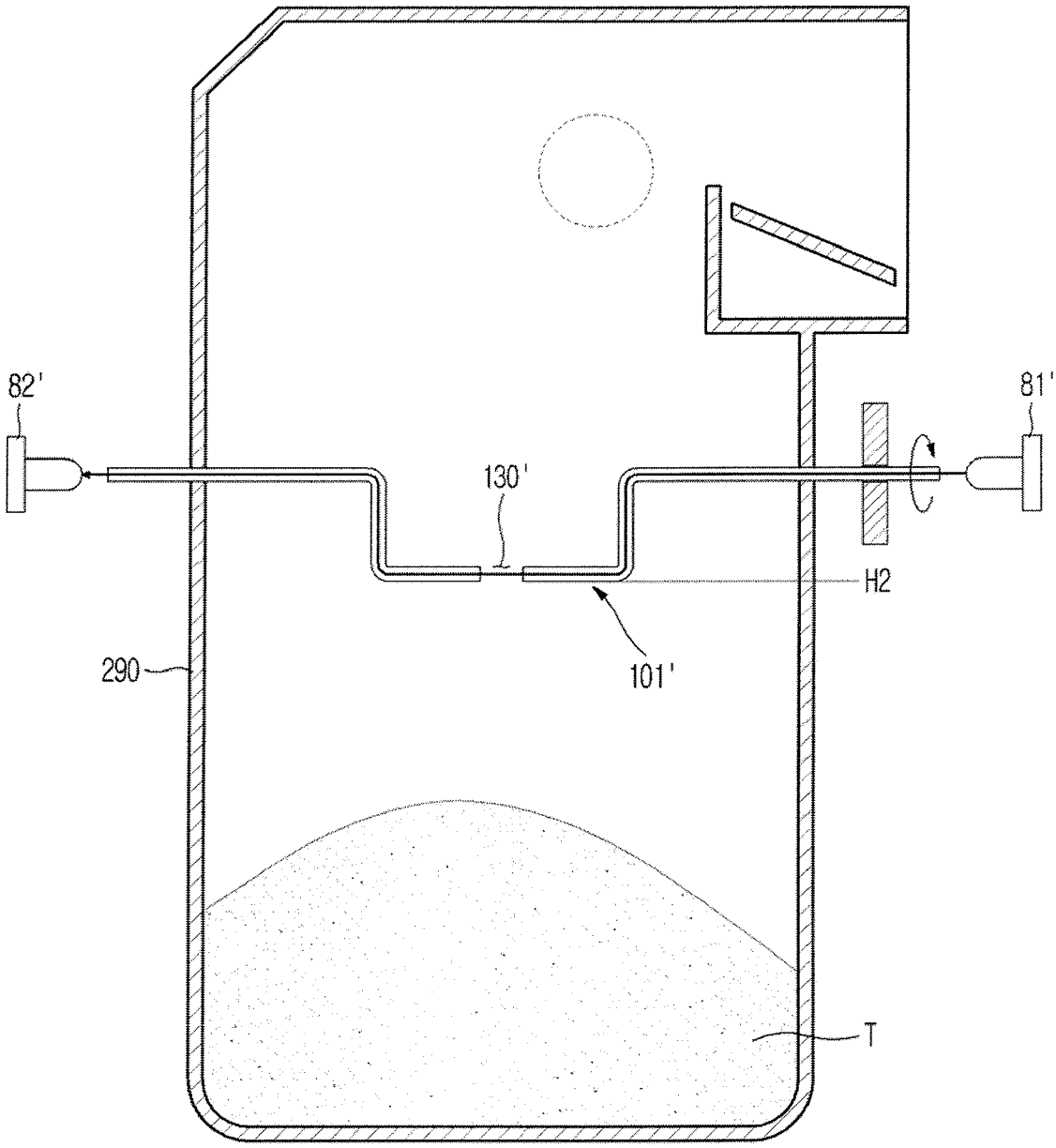
FIG. 8 is a view illustrating the operation of detecting an amount of developer stored in a waste developer container of the image forming apparatus depicted in FIG. 6.

As illustrated in FIG. 8*a*, when the developer T accumulates to a height below a bottom position H2 of the developer detecting region 130' in the waste developer container 290, although the rotating unit 101' rotates, the light emitted from the light emitting part 81' is not blocked by the developer T, and thus the light receiving part 82' receives the light.

Figure 8B:
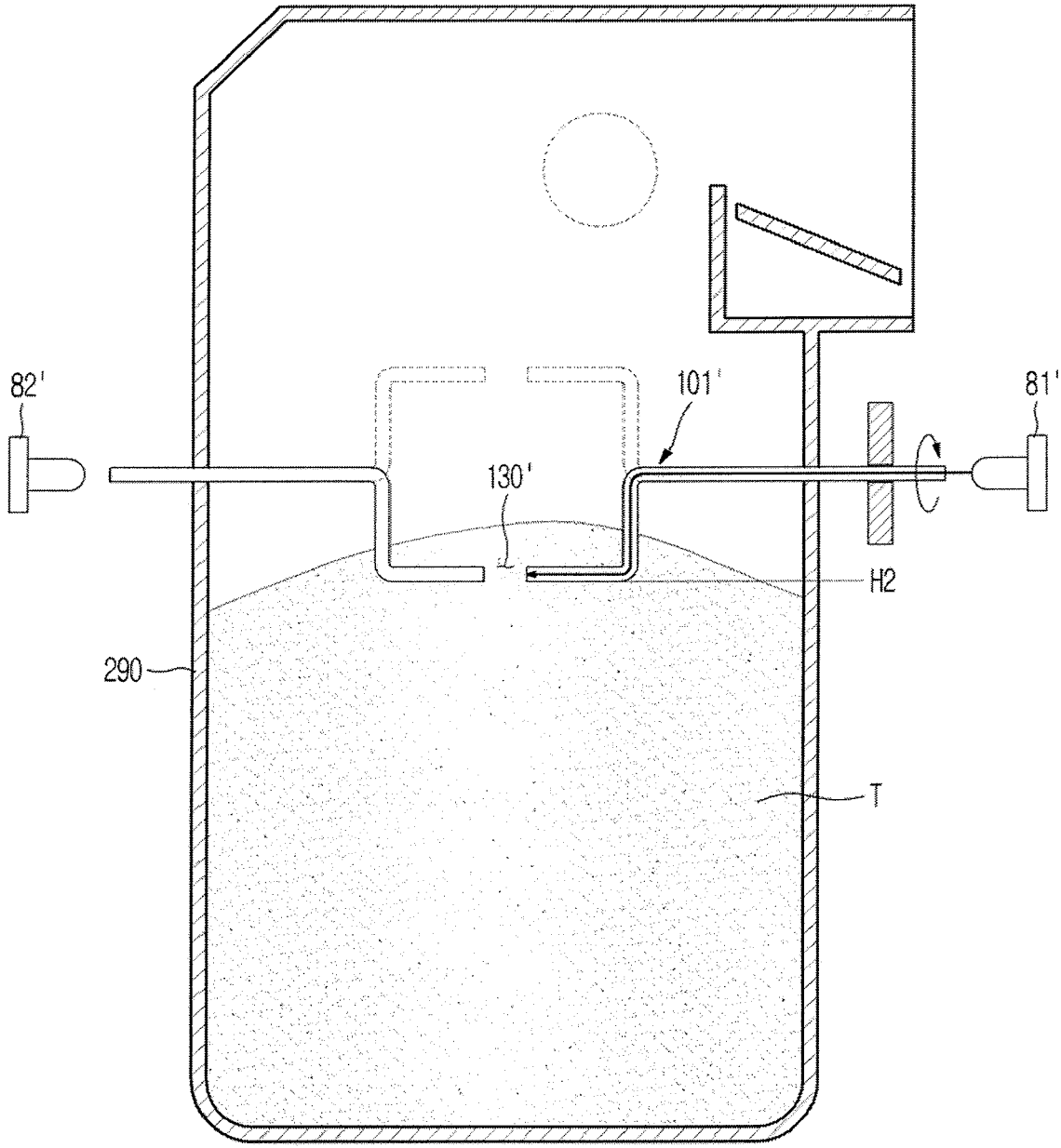

As the printing operation further proceeds, the amount of waste developer increases. As illustrated in FIG. 8B, when the developer T accumulates to a height above the bottom position H2 of the developer detecting region 130' in the waste developer container 290, the developer detecting region 130' passes in the developer T at a partial section while the rotating unit 101' rotates. Accordingly, within a specific time zone corresponding to the above partial section, the light intensity detected from the light receiving part 82' is very weak. When the developer detecting region 130' moves out of the developer T and is exposed to the outside of the developer T (as illustrated by a dotted line in FIG. 8B), the light intensity detected from the light receiving part 82' is strong.

Figure 8C:
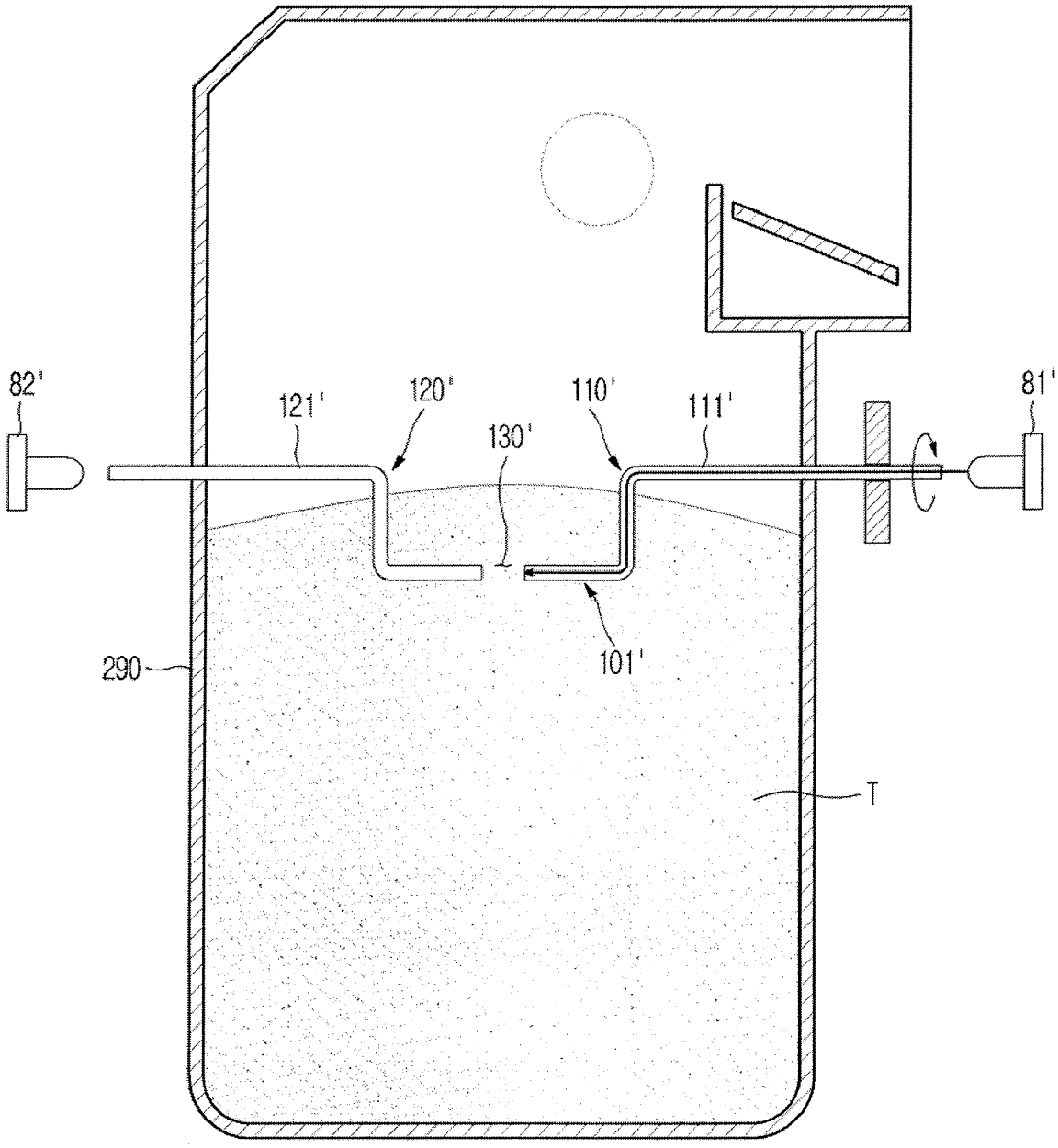

When the developer T further accumulates to a height near the rotating shaft portions 111' and 121' of the rotating members 110' and 120' as illustrated in FIG. 8C, the time required for the rotating unit 101' to pass through the developer T is increased, and thus a weak light intensity is detected from the light receiving part 82' for a longer time than the state in FIG. 8B. When the developer T is further accumulated to a height above the rotating shaft portions 111' and 121' of the rotating members 110' and 120', the light receiving part 82' may not receive the light.

Figure 8D:
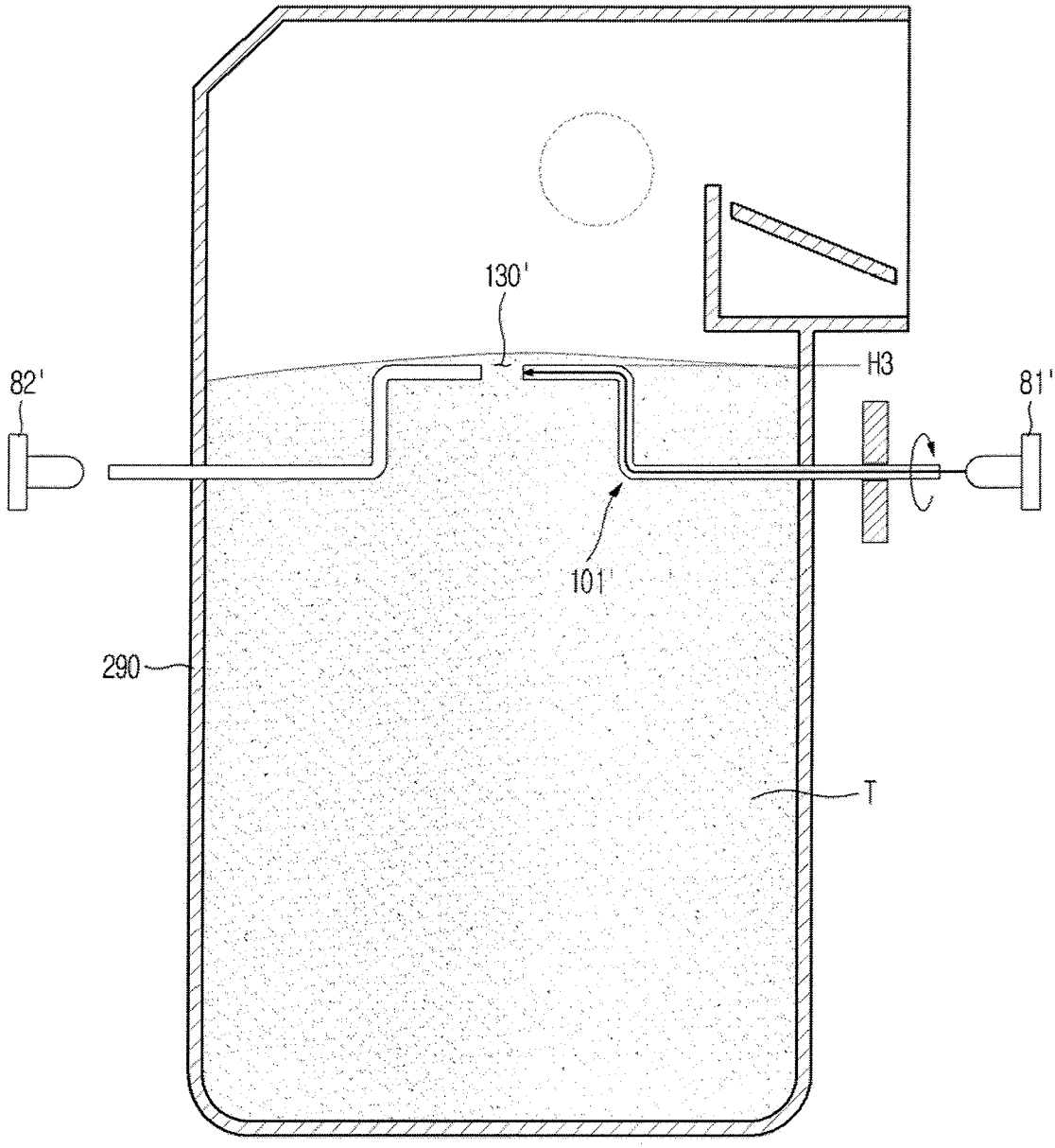

As illustrated in FIG. 8D, when the developer T further accumulates to a height above a top position H3 of the developer detecting region 130', the developer detecting region 130' is not exposed to the exterior of the developer T in spite of the rotation of the rotating unit 101'. Accordingly, the light emitted from the light emitting part 81' is blocked by the developer T existing in the developer detecting region 130' and cannot be transmitted to the light receiving part 82'. In other words, the light receiving part 82' does not receive the light.

As described above, the amount of waste developer accumulated in the waste developer container 290 can be checked in stages by determining whether the light is detected by the light receiving part 82' and analyzing the light detecting pattern at the light receiving part 82'.

As apparent from the above description, according to various embodiments herein, elements to agitate the developer and the elements to detect the amount of developer are provided as one unit. Accordingly, the number of elements and manufacturing costs decrease, and the inner structure of the developing device or the waste developer container can be compactly designed.

Also, when the rotating unit rotates, the developer detecting region moves upward and downward, so that the amount of developer stored in the developing device or the waste developer container can be checked in stages.

Although a few embodiments of the present general inventive concept have been shown and described, it will be appreciated by those skilled in the art that changes may be made in this embodiment without departing from the principles and spirit of the present general inventive concept, the scope of which is defined in the appended claims and their equivalents.

What is claimed is:

1. An image forming apparatus, comprising:

a developer storage part to store a developer;

a light emitting part and a light receiving part to detect an amount of developer stored in the developer storage part; and a rotating unit which rotates to agitate the developer stored in the developer storage part and guides light emitted from the light emitting part to the light receiving part, wherein the rotating unit includes a rotating shaft portion and an extending portion which extends eccentrically from the rotating shaft portion.

2. The image forming apparatus according to claim 1, wherein the rotating unit includes a first rotating shaft portion which has an end disposed opposite to the light emitting part, and a second rotating shaft portion which has an end disposed opposite to the light receiving part.

3. The image forming apparatus according to claim 2, wherein the rotating unit further includes a first extending portion which extends from the first rotating shaft portion, and a second extending portion which extends from the second rotating shaft portion, and wherein the first extending portion and the second extending portion oppose each other and define a developer detecting region between the first extending portion and the second extending portion.

4. The image forming apparatus according to claim 3, further comprising:

a cleaning member which cleans end surfaces of the first extending portion and the second extending portion which define the developer detecting region.

5. The image forming apparatus according to claim 2, further comprising:

an agitating member connected to the first rotating shaft portion at one side and connected to the second rotating shaft portion at the other side to rotate together with the rotating unit.

6. The image forming apparatus according to claim 1, wherein the rotating shaft portion and the extending portion are made of a transparent material.

7. The image forming apparatus according to claim 1, wherein the rotating unit includes a reflecting portion which reflects light moving from the light emitting part to the light receiving part.

8. The image forming apparatus according to claim 1, wherein the rotating unit includes a hollow member, whereby light emitted from the light emitting part is guided to the light receiving part through an interior of the hollow member.

9. The image forming apparatus according to claim 8, wherein the hollow member includes a reflecting surface which is formed on an inner surface.

10. The image forming apparatus according to claim 8, further comprising:

a developer inflow-prevention member mounted to an end of the hollow member to prevent inflow of the developer into the hollow member, the developer inflow-prevention member being made of a transparent material in which light passing through the interior of the hollow member can permeate.

11. The image forming apparatus according to claim 1, further comprising:

a photosensitive member on which an electrostatic latent image is formed according to image information, wherein the developer to be supplied to the photosensitive member is stored in the developer storage part.

12. The image forming apparatus according to claim 1, wherein the developer storage part includes a waste developer container in which waste developer is stored.

13. An image forming apparatus, comprising:

a developer storage part to store a developer;

a light emitting part and a light receiving part to detect an amount of developer stored in the developer storage part;

an agitating device which agitates the developer stored in the developer storage part, wherein the agitating device includes a light guide part which guides light emitted from the light emitting part to the light receiving part, the light guide part includes a first rotating member which has an end disposed opposite to the light emitting part and a second rotating member which has an end disposed opposite to the light receiving part, and the first rotating member and the second rotating member have other ends which oppose each other to define a developer detecting region therebetween.

14. The image forming apparatus according to claim 13, wherein the developer detecting region is positioned at a distance from a rotating axis of the first rotating member and the second rotating member in a radial direction.

15. The image forming apparatus according to claim 13, wherein the first rotating member and the second rotating member are made of a transparent material.

16. The image forming apparatus according to claim 13, further comprising:

a cleaning member which cleans surfaces of the other ends of the first rotating member and the second rotating member which define the developer detecting region.

17. The image forming apparatus according to claim 13, wherein the light guide part includes a hollow member, whereby light emitted from the light emitting part is transmitted to the light receiving part through an interior of the hollow member.

18. The image forming apparatus according to claim 17, further comprising:

a developer inflow-prevention member which is mounted to an end of the hollow member to prevent inflow of the developer into the hollow member, the developer inflow-prevention member being made of a transparent material in which light passing through the interior of the hollow member can permeate.

19. The image forming apparatus according to claim 13, wherein the first rotating member and the second rotating member include reflecting surfaces provided at bent portions of the first rotating member and the second rotating member.

20. The image forming apparatus according to claim 13, wherein the agitating device further includes an agitating member connected to the first rotating member at one side and connected to the second rotating member at another side to rotate together with the first rotating member and the second rotating member.

21. The image forming apparatus according to claim 13, further comprising:

a photosensitive member on which an electrostatic latent image is formed according to image information, wherein the developer to be supplied to the photosensitive member is stored in the developer storage part.

22. The image forming apparatus according to claim 13, wherein the developer storage part includes a waste developer container in which waste developer is stored.

23. A developer container, comprising:

a developer housing; and a rotating unit extending from one side of the housing to an opposite side thereof, the rotating unit including a first rotating shaft portion extending at a first end from the one side of the housing and having an eccentric shape and a second rotating shaft portion extending at a first end from the opposite side of the housing and having an eccentric shape such that a second end of the first and second rotating shaft portions face each other and have a gap therebetween, wherein one of the first and second rotating shaft portions receives light from a light emitting unit and transmits the light to the other of the first and second rotating shaft portions to transmit the light to a light receiving unit in order to determine an amount of developer in the developer housing.

* * * * *